US011697289B2

(12) United States Patent
Goto

(10) Patent No.: US 11,697,289 B2
(45) Date of Patent: Jul. 11, 2023

(54) LIQUID CIRCULATION DEVICE AND LIQUID DISCHARGE APPARATUS

(71) Applicant: TOSHIBA TEC KABUSHIKI KAISHA, Tokyo (JP)

(72) Inventor: Taiki Goto, Izunokuni Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/398,802

(22) Filed: Aug. 10, 2021

(65) Prior Publication Data

US 2022/0169033 A1 Jun. 2, 2022

(30) Foreign Application Priority Data

Dec. 1, 2020 (JP) ..... 2020-199685
Apr. 16, 2021 (JP) ..... 2021-069657

(51) Int. Cl.
*B41J 2/18* (2006.01)
*B41J 2/045* (2006.01)
*B41J 2/175* (2006.01)

(52) U.S. Cl.
CPC ..... *B41J 2/18* (2013.01); *B41J 2/0454* (2013.01); *B41J 2/04563* (2013.01); *B41J 2/17596* (2013.01); *B41J 2202/12* (2013.01)

(58) Field of Classification Search
CPC ..... B41J 2/18; B41J 2/0454; B41J 2202/12; B41J 2/04563; B41J 29/38; B41J 2/17566; B41J 2/175; B41J 2/17596
See application file for complete search history.

(56) References Cited

U.S. PATENT DOCUMENTS 9,649,849 B2 5/2017 Ohtsu et al.
10,022,978 B2 7/2018 Ohtsu et al.
10,661,575 B2 5/2020 Goto et al.
10,737,502 B2 8/2020 Goto et al.
(Continued)

FOREIGN PATENT DOCUMENTS

EP 0577186 A1 1/1994
EP 3636441 A1 4/2020
(Continued)

OTHER PUBLICATIONS

Extended European Search Report dated Feb. 7, 2022, in corresponding European Patent Application No. 21196499.4, 11 pages.

*Primary Examiner* — Jannelle M Lebron
(74) *Attorney, Agent, or Firm* — Kim & Stewart LLP

(57) ABSTRACT

A liquid circulation device includes a liquid chamber that stores a liquid that is to be supplied to a liquid discharge head. A pipeline through which the liquid can be circulated between the liquid chamber and the liquid discharge head is provided. A heater heats the liquid circulating in the pipeline. A first temperature sensor measures the temperature of the heater, and a second temperature sensor measures the temperature of the liquid in the pipeline. A controller controls the heating of the heater based on the liquid temperature measured by the second temperature sensor. The controller also monitors a change in the measured temperature of the heater over time and turns off the heating of the heater when the monitored change satisfies a predetermined stop condition.

18 Claims, 10 Drawing Sheets

(56) References Cited

U.S. PATENT DOCUMENTS

| | | | | |
|---|---|---|---|---|
| 10,737,503 | B2 | 8/2020 | Hara et al. | |
| 2009/0256870 | A1* | 10/2009 | Nakamura | B41J 2/17596 347/17 |
| 2011/0242156 | A1 | 10/2011 | Shimoda | |
| 2020/0114644 | A1* | 4/2020 | Sato | B41J 2/18 |
| 2020/0298581 | A1* | 9/2020 | Hara | B41J 2/17596 |

FOREIGN PATENT DOCUMENTS

| | | | |
|---|---|---|---|
| EP | 3711958 | A1 | 9/2020 |
| JP | 2011-051170 | A | 3/2011 |
| JP | 2017-018845 | A1 | 1/2017 |
| JP | 2017-105212 | A | 6/2017 |

* cited by examiner

LIQUID CIRCULATION DEVICE AND LIQUID DISCHARGE APPARATUS

CROSS-REFERENCE TO RELATED APPLICATION

This application is based upon and claims the benefit of priority from Japanese Patent Application No. 2020-199685, filed Dec. 1, 2020, and Japanese Patent Application No. 2021-069657, filed Apr. 16, 2021, the entire contents of which are incorporated herein by reference.

FIELD

Embodiments described herein relate generally to a liquid circulation device, a liquid discharge apparatus, and a method for controlling a liquid circulation device.

BACKGROUND

There is a liquid circulation device in which liquid circulates along a circulation path that includes a liquid discharge head. Such a liquid circulation device is used in an ink jet printer or the like and ejects ink from the liquid discharge head onto a recording medium to form an image thereon. The ink used in the ink jet printer has a temperature range that is considered suitable for ejected ink droplets. Therefore, a heater can be installed along the circulation path and controlled so that temperature of the ink flowing through the circulation path is maintained within the suitable temperature range.

Normally, this type of liquid circulation device performs heating control in a state in which there is a sufficient amount of ink to be circulated in the circulation path. However, heating control may also need to be performed when the ink is not being circulated for some reason. If the heating control is performed while the ink is not being circulated, the temperature of the heater may rise abruptly. If overheating occurs and the temperature exceeds an upper limit, a thermal fuse is likely to be triggered or the heater may be broken. Since the temperature of ink in the vicinity of the heater also rises abruptly, the characteristics of the ink are likely to be altered near the heater.

DETAILED DESCRIPTION

Embodiments provide a technique for preventing faults due to overheating in a liquid circulation device in which circulating liquid is heated by a heater or a liquid discharge device using the such a circulation device.

In general, according to one embodiment, a liquid circulation device includes a liquid chamber that stores a liquid to be supplied to a liquid discharge head, a pipeline through which the liquid can be circulated between the liquid chamber and the liquid discharge head, a heater configured to heat the liquid circulating in the pipeline, a first temperature sensor configured to measure a temperature of the heater, a second temperature sensor configured to measure a temperature of the liquid circulating in the pipeline, and a controller. The controller is configured to control the heater based on the temperature of the liquid measured by the second temperature sensor and monitor a change in the temperature of the heater as measured by the first temperature sensor and turn off the heater when the change satisfies a predetermined stop condition.

Hereinafter, a liquid circulation device and a liquid discharge apparatus according to one or more embodiments will be described with reference to the drawings. In this disclosure, an ink jet printer that ejects ink droplets from a circulation type liquid discharge head to form an image on a recording medium is described as an example of a liquid circulation device and a liquid discharge apparatus.

First Embodiment

Figure 1:
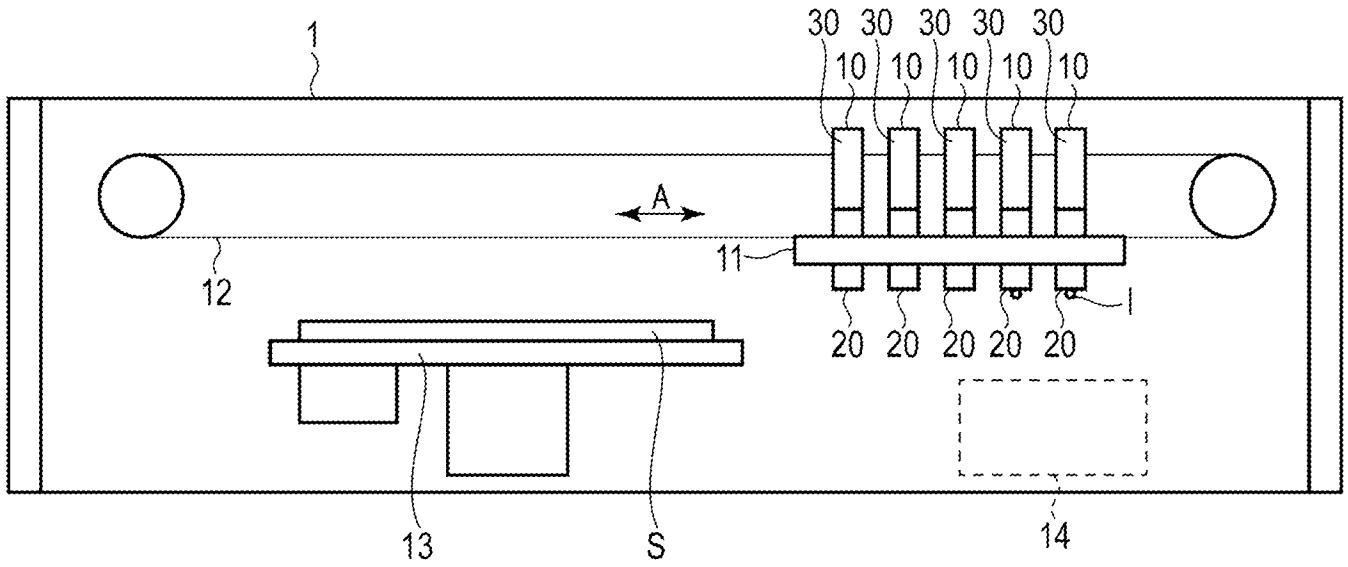
FIG. 1 is a side view of an ink jet printer according to an embodiment.

First, a first embodiment will be described with reference to FIGS. 1 to 8. FIG. 1 is a schematic side view of an ink jet printer 1. The ink jet printer 1 includes a plurality of liquid discharge apparatuses 10, a head support mechanism 11, a head drive mechanism 12, a medium support mechanism 13, and a printer controller 14.

The head support mechanism 11 supports a plurality of liquid discharge apparatuses 10 in along the direction of arrow A. The head drive mechanism 12 reciprocates the plurality of liquid discharge apparatuses 10 in the directions of arrow A moving the head support mechanism 11 in the direction of arrow A. The medium support mechanism 13 movably supports a recording medium S in a direction orthogonal to the direction of the arrow A at a position facing the plurality of liquid discharge apparatuses 10. The printer controller 14 controls each component of the ink jet printer 1 including the head drive mechanism 12.

Each liquid discharge apparatus 10 integrally includes a liquid discharge head 20 and a liquid circulation device 30. The liquid discharge apparatus 10 ejects, for example, ink I from the liquid discharge head 20 while moving in the direction of the arrow A to form an image on the recording medium S that is supported by the medium support mechanism 13.

The liquid discharge apparatuses 10 each eject a different color ink, for example, cyan ink, magenta ink, yellow ink, black ink, and white ink, are ejected. Although the inks used by the plurality of liquid discharge apparatuses 10 are all different from each other, the plurality of liquid discharge apparatuses 10 have the same configuration. The color or other characteristics of the ink I used are not limited to those examples. For example, instead of white ink, transparent glossy ink, special ink that develops color when irradiated with infrared rays or ultraviolet rays, or the like may be ejected.

Figure 2:
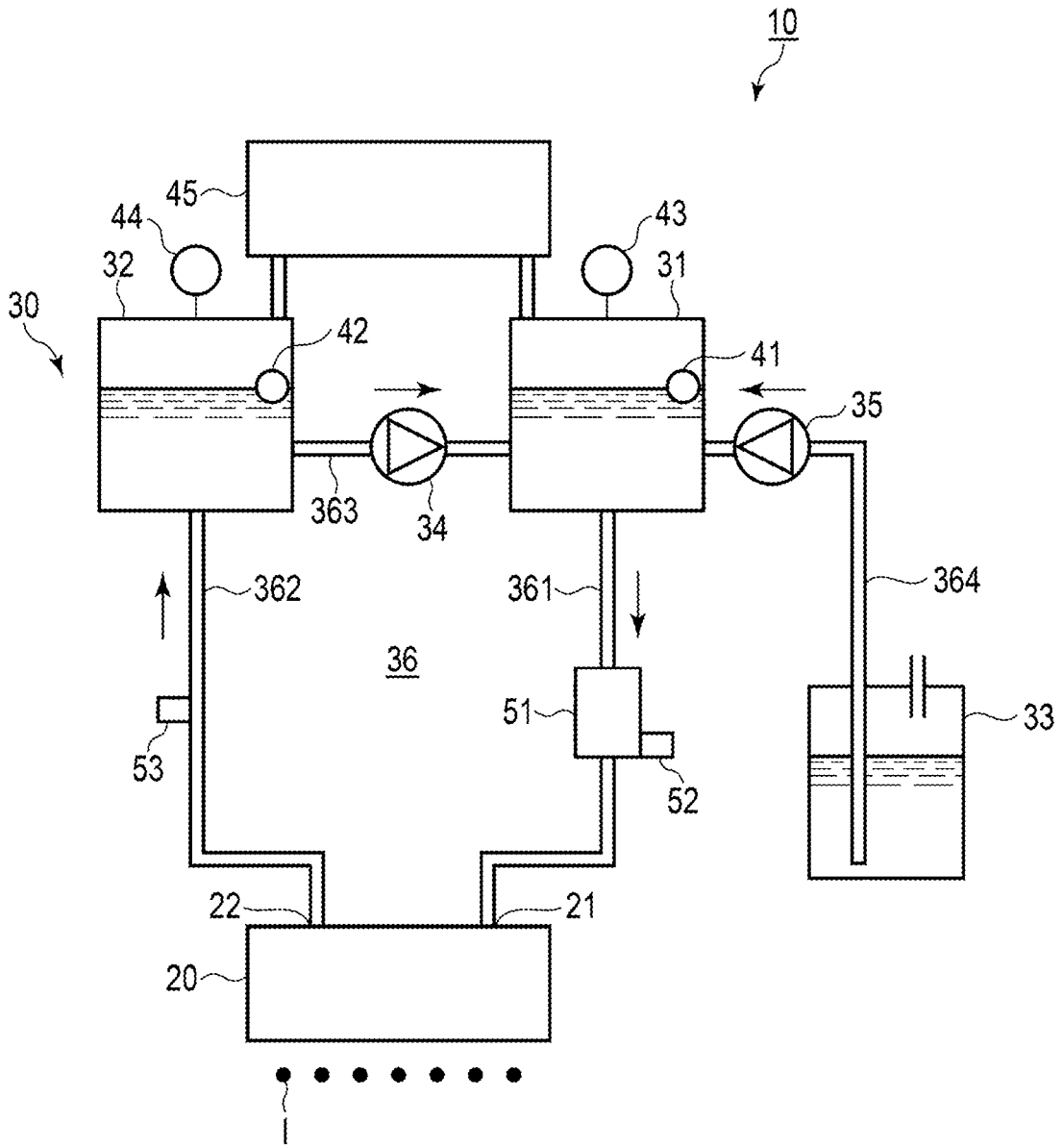
FIG. 2 is a schematic diagram of a liquid discharge head and a liquid circulation device of a liquid discharge apparatus in an ink jet printer.

FIG. 2 is a schematic diagram of the liquid discharge head 20 and the liquid circulation device 30 of the liquid discharge apparatus 10. The liquid discharge head 20 includes an ink supply port 21 and an ink discharge port 22. The liquid discharge head 20 forms an ink flow path inside the liquid discharge head 20 so that ink supplied from the supply port 21 is discharged from the discharge port 22.

In the liquid discharge head 20, a plurality of pressure chambers are formed in the middle part of the ink flow path. The liquid discharge head 20 supplies ink to each pressure chamber through the ink flow path. The liquid discharge head 20 includes a nozzle and an actuator for each pressure chamber. The nozzle communicates with a corresponding pressure chamber. The actuator displaces a volume of the corresponding pressure chamber. In the liquid discharge head 20, ink I in the pressure chamber is ejected from the nozzle communicating with the pressure chamber by changing the volume of the pressure chamber by action of the actuator. The liquid discharge head 20 sends the ink in each pressure chamber that has not been ejected from the nozzle to the discharge port 22.

The liquid circulation device 30 is integrally connected to the liquid discharge head 20 at the upper part of the liquid discharge head 20 by, for example, a metallic connecting component. The liquid circulation device 30 includes an upstream tank 31, a downstream tank 32, a replenishment tank 33, a circulation pump 34, and a replenishment pump 35. The upstream tank 31, the downstream tank 32, and the replenishment tank 33 store the same type of ink. The circulation pump 34 is for sending the ink stored in the downstream tank 32 to the upstream tank 31. The replenishment pump 35 replenishes the upstream tank 31 with the ink stored in the replenishment tank 33.

The liquid circulation device 30 includes a first pipeline 361, a second pipeline 362, a third pipeline 363, and a fourth pipeline 364. The first pipeline 361 is a pipeline connecting the upstream tank 31 and the supply port 21 of the liquid discharge head 20. The second pipeline 362 is a pipeline connecting the discharge port 22 of the liquid discharge head 20 and the downstream tank 32. The third pipeline 363 is a pipeline connecting the downstream tank 32 and the upstream tank 31. The fourth pipeline 364 is a pipeline connecting the supply tank 33 and the upstream tank 31.

The ink stored in the upstream tank 31 is transferred to the supply port 21 of the liquid discharge head 20 through the first pipeline 361, and passes through the ink flow path inside the liquid discharge head 20. The ink discharged from the discharge port 22 is transferred to the downstream tank 32 through the second pipeline 362 and stored in the downstream tank 32. The ink stored in the downstream tank 32 is transferred to the upstream tank 31 through the third pipeline 363 by action of the circulation pump 34, and returns to the upstream tank 31.

As described above, the first pipeline 361, the second pipeline 362, and the third pipeline 363 configure a circulation path 36 for circulating ink between the upstream tank 31 and the liquid discharge head 20.

The liquid discharge apparatus 10 ejects the ink that circulates in the circulation path 36 from the liquid discharge head 20. For that reason, the amount of ink stored in the upstream tank 31 is gradually reduced. If the amount of ink decreases, ink stored in the replenishment tank 33 is transferred to the upstream tank 31 through the fourth pipeline 364 by action of the replenishment pump 35 so that the upstream tank 31 is replenished (refilled) with the ink.

In the liquid circulation device 30, liquid level sensors 41 and 42 are provided inside the upstream tank 31 and the downstream tank 32, respectively. The liquid level sensor 41 measures the amount of ink in the upstream tank 31. The liquid level sensor 42 measures the amount of ink in the downstream tank 32. The printer controller 14 appropriately controls the replenishment pump 35 based on the measurement results of the liquid level sensors 41 and 42 to replenish the upstream tank 31 with the ink from the replenishment tank 33. The printer controller 14 replenishes the upstream tank 31 to adjust the amount of ink circulating in the circulation path 36 to be an appropriate amount (level).

In the liquid circulation device 30, pressure sensors 43 and 44 are provided in the upstream tank 31 and the downstream tank 32, respectively. The pressure sensor 43 measures pressure in the upstream tank 31. The pressure sensor 44 measures pressure in the downstream tank 32. The liquid circulation device 30 includes a pressure adjustment mechanism 45. The pressure adjustment mechanism 45 opens the upstream tank 31 and the downstream tank 32 to the outside (atmosphere), or pressurizes and depressurizes the downstream tank 32. The printer controller 14 appropriately controls the pressure adjustment mechanism 45 based on the measurement results of the pressure sensors 43 and 44 to adjust pressure in the circulation path 36. The printer controller 14 adjusts ink pressure of the nozzle in the liquid discharge head 20 by adjusting pressure in the circulation path 36.

In the liquid circulation device 30, a heater 51 is provided in the middle part of the first pipeline 361. The heater 51 heats the ink flowing in the first pipeline 361. In the liquid circulation device 30, a first temperature sensor 52 is provided on the heater 51. The first temperature sensor 52 measures the temperature of the heater 51. In the liquid circulation device 30, a second temperature sensor 53 is provided in the middle part of the second pipeline 362. The second temperature sensor 53 measures the temperature of the ink flowing through the second pipeline 362. The printer controller 14 controls ON or OFF of energization of the heater 51 based on the measurement result of the second temperature sensor 53, and adjusts the temperature of the ink flowing through the circulation path 36 to an appropriate temperature. The printer controller 14 prevents the heater 51 from overheating based on the measurement result of the first temperature sensor 52.

Figure 3:
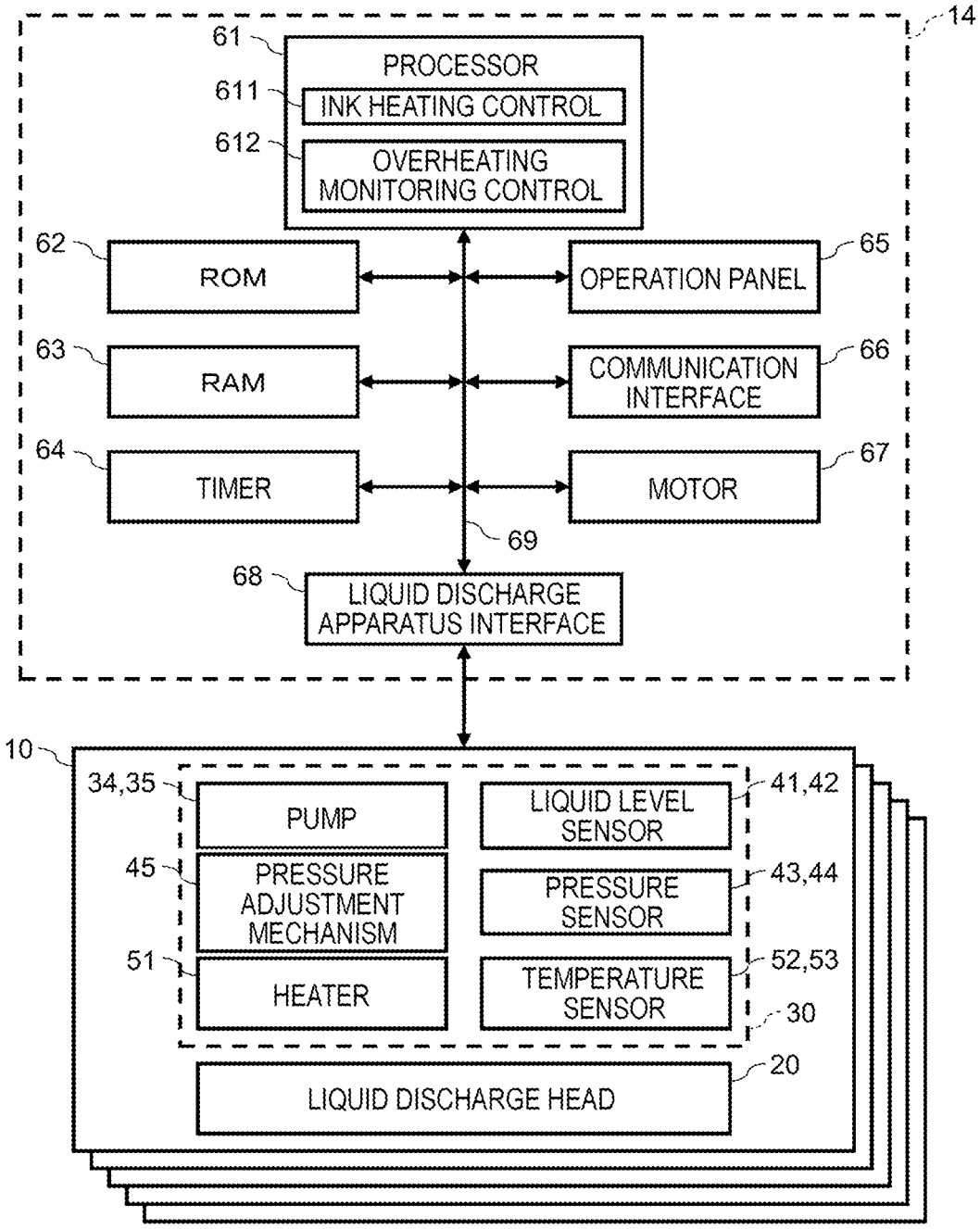
FIG. 3 is a hardware block diagram of an ink jet controller of an ink jet printer.

FIG. 3 is a hardware block diagram of the printer controller 14. The printer controller 14 includes a processor 61, a read only memory (ROM) 62, a random access memory (RAM) 63, a timer 64, an operation panel 65, a communication interface 66, a motor 67, and a liquid discharge apparatus interface 68. The processor 61, the ROM 62, the RAM 63, the timer 64, the operation panel 65, the communication interface 66, the motor 67, and the liquid discharge apparatus interface 68 are connected to each other by a system bus 69. The system bus 69 includes an address bus, a data bus, and the like.

The processor 61 controls each component of the ink jet printer 1 and performs various functions thereof according to an operating system and one or more application programs.

The ROM 62 stores the operating system and application programs described above. The ROM 62 may store data required for the processor 61 to execute a process for controlling each component.

The RAM 63 stores data required for the processor 61 to execute a process. The RAM 63 is also used as a work area where data is temporarily stored by the processor 61. The work area includes an image memory onto which print data (corresponding to the image to be printed on recording medium S) is loaded.

The timer 64 tracks current time or the like. The operation panel 65 includes an operation unit and a display unit. On the operation unit, function keys such as a power key and an error release key are disposed. The display unit can display various states of the ink jet printer 1.

The communication interface 66 is a network interface circuit configured to receive print data from a client terminal connected via a network such as a local area network (LAN). If an error occurs in the ink jet printer 1, for example, the communication interface 66 transmits a signal notifying the client terminal or the like of the error. The motor 67 is a drive source for the head support mechanism 11 and the medium support mechanism 13.

The liquid discharge apparatus interface 68 relays signals transmitted and received between the processor 61 and the plurality of liquid discharge apparatuses 10. The signals transmitted from the processor 61 to each liquid discharge apparatus 10 include: a signal for controlling the liquid discharge head 20, a signal for controlling each of the circulation pump 34, the replenishment pump 35, the pressure adjustment mechanism 45, and the heater 51 in the liquid circulation device 30, and the like. The signals transmitted from each liquid discharge apparatus 10 to the processor 61 include measurement signals from the liquid level sensors 41 and 42, the pressure sensors 43 and 44, and the first and second temperature sensors 52 and 53 in the liquid circulation device 30.

In such a configuration, the processor 61 performs at least ink heating control processing 611 and overheating monitoring control processing 612. These functions are performed for each liquid discharge apparatus 10. These functions are implemented by one or more programs stored in the ROM 62.

Figure 4:
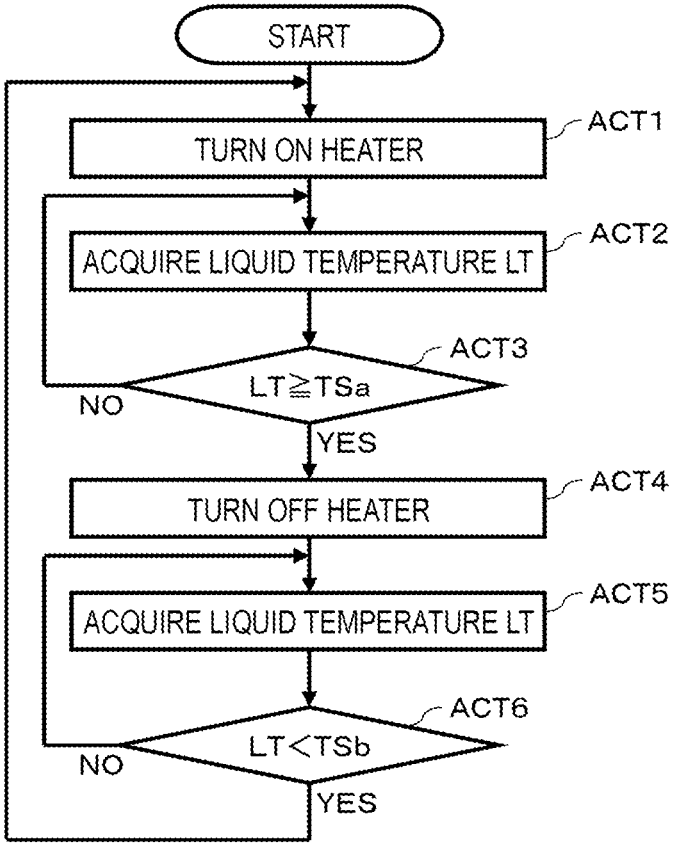
FIG. 4 is a flowchart of ink heating control processing.

FIG. 4 is a flowchart of the ink heating control processing 611 performed on one liquid discharge apparatus 10. The ink heating control processing 611 for the other liquid discharge apparatuses 10 is similar, and thus the description here will be omitted. The heater 51 and the second temperature sensor 53 are provided in the liquid circulation device 30 of the target liquid discharge apparatus 10.

When the processor 61 starts the ink heating control 611 processing, the processor 61 turns ON energization to the heater 51 as ACT 1. Then, the processor 61 acquires a liquid temperature LT measured by the second temperature sensor 53 as ACT 2. The liquid temperature LT is a temperature of the ink flowing through the second pipeline 362.

The processor 61 checks whether the liquid temperature LT is equal to or greater than a first threshold value TSa as ACT 3. The first threshold value TSa is an upper limit temperature in a suitable temperature range for ejecting ink droplets. An optimum value of the first threshold value TSa depends on the type of ink used in the liquid discharge apparatus 10, a flow rate of the ink, and the like, and is stored in the RAM 63.

If the liquid temperature LT is less than the first threshold value TSa, the processor 61 determines that the check result in ACT 3 is NO and returns to ACT 2. The processor 61 repeatedly executes the processes of ACT 2 and ACT 3 until the liquid temperature LT becomes equal to or greater than the first threshold value TSa.

If the liquid temperature LT becomes equal to or greater than the first threshold value TSa, the processor 61 determines that the check result in ACT 3 is YES and proceeds to ACT 4. The processor 61 turns OFF energization to the heater 51 as ACT 4. Then, the processor 61 acquires the liquid temperature LT measured by the second temperature sensor 53 as ACT 5.

The processor 61 checks whether the liquid temperature LT is less than a second threshold value TSb as ACT 6. The second threshold value TSb is a lower limit temperature in the suitable temperature range for ejecting ink droplets. An optimum value of the second threshold value TSb depends on the type of ink used in the liquid discharge apparatus 10, the flow rate of the ink, and the like, and is stored in the RAM 63.

If the liquid temperature LT is equal to or greater than the second threshold value TSb, the processor 61 determines that the check result in ACT 6 is NO and returns to ACT 5. The processor 61 repeatedly executes the processes of ACT 5 and ACT 6 until the liquid temperature LT becomes less than the second threshold value TSb.

If the liquid temperature LT becomes less than the second threshold value TSb, the processor 61 determines that the check result in ACT 6 is YES and returns to ACT 1. The processor 61 turns ON energization to the heater 51 as ACT 1. After that, the processor 61 executes the processes of ACT 2 and subsequent actions in the same manner as described above.

As described above, the processor 61 controls turning ON or OFF of power to the heater 51 so that the temperature of the ink flowing through the circulation path 36 falls within the suitable temperature range for ejecting ink droplets. By this control, during normal use of the ink jet printer 1, the temperature of the ink ejected from each liquid discharge apparatus 10 is appropriately adjusted to be within the suitable temperature range for ejecting ink droplets. As a result, high quality printing becomes possible.

Here, the processor 61 performs the ink heating control processing 611 by controlling an output of the heater 51 based on the ink temperature measured by the second temperature sensor 53.

In the liquid circulation device 30, ink heating control is usually performed by the processor 61 in a state in which a sufficient amount of ink is being circulated in the circulation path 36. However, such ink heating control may be performed without the ink presently being circulating, due to, for example, a failure of the circulation pump 34 or an occurrence of an error in the process of controlling the circulation pump 34. If the ink heating control is performed when the ink is not being circulated, the temperature of the heater 51 will rise abruptly. If the temperature of the heater 51 rises abruptly and overheating that exceeds the upper limit temperature of the heater 51 occurs, a thermal fuse is likely to be triggered or the heater 51 is likely to be broken. Since the temperature of the ink in the vicinity of the heater 51 rises abruptly, the characteristics of the ink are likely to be altered. In order to prevent such issues, the processor 61 performs the overheating monitoring control processing 612 for monitoring overheating of the heater 51.

Figure 5:
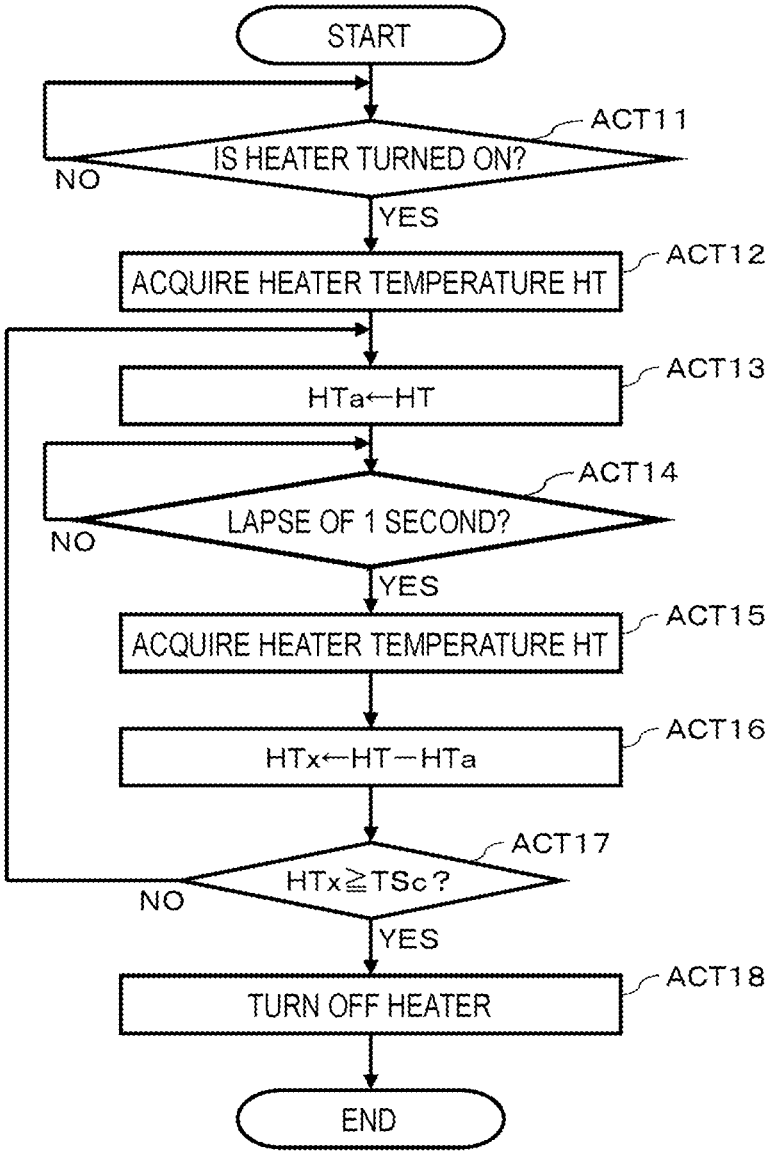
FIG. 5 is a flowchart of overheating monitoring control processing.

FIG. 5 is a flowchart of the overheating monitoring control processing 612 performed for a liquid discharge apparatus 10. The overheating monitoring control processing 612 for each liquid discharge apparatus 10 is similar, and thus specific description will be omitted. The heater 51 and the first temperature sensor 52 are provided in the liquid circulation device 30 of the target liquid discharge apparatus 10.

The processor 61 checks whether energization to the heater 51 is turned ON as ACT 11. If energization to the heater 51 is not turned ON, it is determined that the check result in ACT 11 is NO. The processor 61 waits for energization to the heater 51 to be turned ON.

In the ink heating control processing 611 described with reference to FIG. 4, if energization to the heater 51 is turned ON, the processor 61 determines that the check result in ACT 11 is YES and proceeds to ACT 12. The processor 61 acquires a heater temperature HT measured by the first temperature sensor 52 as ACT 12. The heater temperature HT is the temperature of the heater 51. The processor 61 stores the heater temperature HT in the RAM 63 as a previous heater temperature HTa as ACT 13.

The processor 61 waits for one second using the function of the timer 64 as ACT 14. After one second lapses, the processor 61 determines that the check result in ACT 14 is YES and proceeds to ACT 15. The processor 61 acquires the heater temperature HT measured by the first temperature sensor 52 as ACT 15.

The processor 61 calculates a temperature rise HTx per second by subtracting the previous heater temperature HTa stored in the RAM 63 from the heater temperature HT as ACT 16. Then, the processor 61 checks whether the temperature rise HTx is equal to or greater than a third threshold value TSc as ACT 17.

The third threshold value TSc is a value suitable for recognizing that the temperature rise HTx per second, that is, rate of the temperature change per unit time, has a risk of overheating of the heater 51. For example, if the temperature of the heater 51 rises by about 2° C. in one second, the heater 51 is considered to be at risk of overheating of the heater 51. Therefore, the third threshold value TSc is set to 2° C.

In ACT 17, if the temperature rise HTx is less than the third threshold value TSc, the processor 61 determines that the check result in ACT 17 is NO and returns to ACT 13. The heater temperature HT acquired in the process of ACT 15 is written into the RAM 63 as the previous heater temperature HTa. After that, the processor 61 executes the processes of ACT 14 and subsequent actions in the same manner as described above.

In ACT 17, if the temperature rise HTx is equal to or greater than the third threshold value TSc, the processor 61 determines that the check result in ACT 17 is YES and proceeds to ACT 18. The processor 61 turns OFF energization to the heater 51 as ACT 18. Thus, the processor 61 ends the control of the procedure illustrated in the flowchart of FIG. 5.

As such, the processor 61 monitors the heater temperature HT measured by the second temperature sensor 53 if energization to the heater 51 is turned ON. Then, if the temperature rise HTx per second of the heater temperature HT becomes equal to or greater than the third threshold value TSc, the processor 61 turns OFF power to the heater 51. If the temperature rise HTx per second of the heater temperature HT becomes equal to or greater than the third threshold value TSc, there is considered to be a risk of overheating being caused by the heater 51. If overheating occurs, a thermal fuse is likely to be triggered or the heater 51 is likely to be broken. Since the temperature of the ink in the vicinity of the heater 51 rises abruptly, the characteristics of the ink are likely to be altered.

In this embodiment, if the temperature rise HTx per second of the heater temperature HT becomes equal to or greater than the third threshold value TSc, energization to the heater 51 is turned OFF. Accordingly, it is possible to prevent overheating by the heater 51. As a result, the thermal fuse will not be triggered and the heater 51 will not break due to overheating. Likewise, the characteristics of the ink near heater 51 will not be altered due to overheating.

Here, the processor 61 performs the overheating monitoring control processing 612 by monitoring the temperature change of the heater 51 measured by the first temperature sensor 52 and turning off the heater 51 if the temperature change satisfies the predetermined condition.

Figure 6:
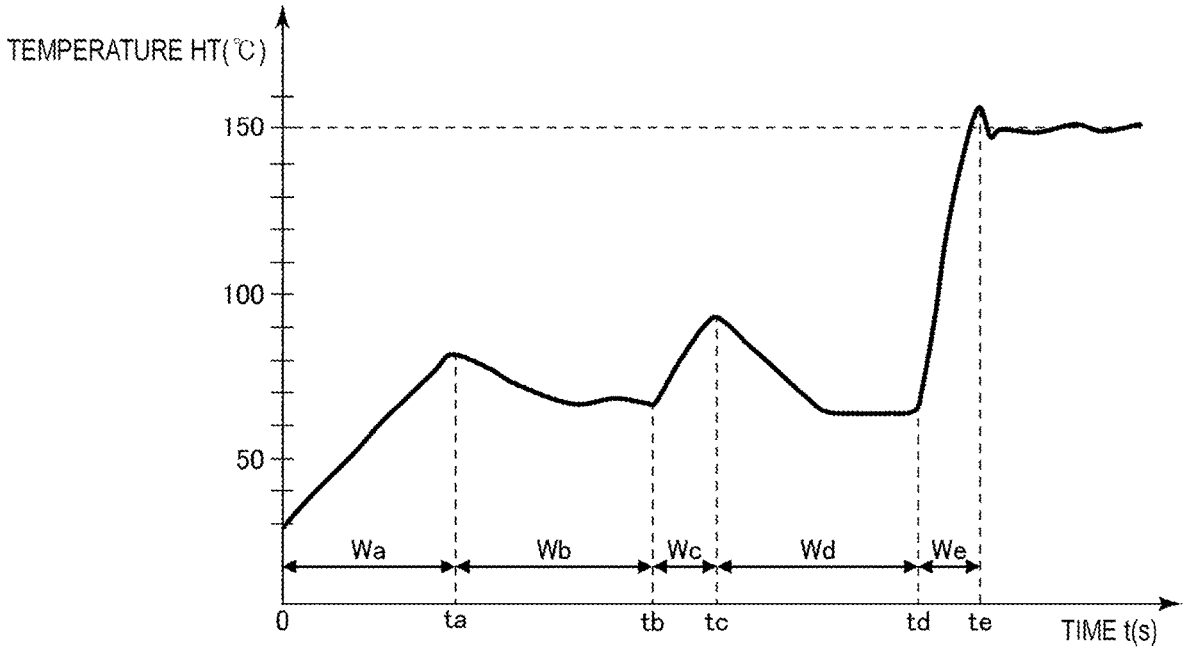
FIG. 6 is a graph of temperature changes of a heater due to ink heating control and overheating monitoring control.

FIG. 6 is a graph of temperature changes of the heater 51 controlled by the ink heating control processing 611 and the overheating monitoring control processing 612. In FIG. 6, the vertical axis represents the temperature HT(° C.) of the heater 51, and the horizontal axis represents the time t (seconds).

In FIG. 6, when the time t is zero, energization of the heater 51 is started (turned ON) in ACT 1 of the ink heating control processing 611. If energization to the heater 51 is turned ON, the temperature HT of the heater 51 will gradually rise with the lapse of time t as illustrated in a section Wa. However, the rate of the temperature change per unit time in section Wa does not become equal to or greater than the rate set by the third threshold value TSc.

In FIG. 6, when the time t equals time ta, energization to the heater 51 is turned OFF in ACT 4 of the ink heating control processing 611. When energization to the heater 51 is turned OFF, the temperature HT of the heater 51 begins to decrease with time t as illustrated in a section Wb.

In FIG. 6, when the time t is equal to time tb, the upstream tank 31 is replenished with the ink from the replenishment tank 33 by the replenishment pump 35. By the replenishment, the temperature of the ink circulating in the circulation path 36 would usually be reduced, and thus energization to the heater 51 is turned ON. As a result, the temperature HT of the heater 51 rises, as illustrated in a section Wc. However, the rate of the temperature change per unit time of this section Wc does not become equal to or greater than the rate which is set by the third threshold value TSc.

In FIG. 6, when the time t is equal to time tc, energization to the heater 51 is turned OFF in ACT 4 of the ink heating control processing 611. When energization to the heater 51 is turned OFF, the temperature HT of the heater 51 decreases as illustrated in a section Wd.

In FIG. 6, when the time t is equal to time td, the ink is not circulating in the circulation path 36. If the ink does not circulate in the circulation path 36, the temperature HT of the heater 51 rises sharply and substantially as illustrated in a section We. The rate of the temperature change per unit time in this section We is equal to or greater than the rate which is set by the third threshold value TSc. If such a state of rising temperature of the heater 51 is left unaddressed, the temperature HT will exceed an upper limit temperature, for example, 150° C., as illustrated at time te. If the temperature HT of the heater 51 exceeds the upper limit temperature, the thermal fuse triggers or the heater 51 breaks. The characteristics of the ink are also altered due to overheating.

In this embodiment, if an abrupt rise in the heater temperature HT, such as illustrated in the section We, is detected, energization to the heater 51 is turned OFF at an early stage in the section We. Accordingly, it is possible to prevent overheating of the heater 51 beyond the upper limit temperature. As a result, there is no concern that the thermal fuse operates or the heater 51 breaks. The ink characteristics are less likely to be altered due to overheating when the maximum experienced temperature of the ink is kept lower.

Although the first embodiment of the liquid circulation device 30 and the liquid discharge apparatus 10 is described above, the present disclosure is not limited to the examples described above.

For example, in the first embodiment, the third threshold value TSc to be compared with the inclination of the temperature change per unit time is set as a fixed value. However, in other examples, the third threshold value TSc may be variable according to the temperature of the surrounding environment in which the liquid circulation device 30 is located.

Figure 7:
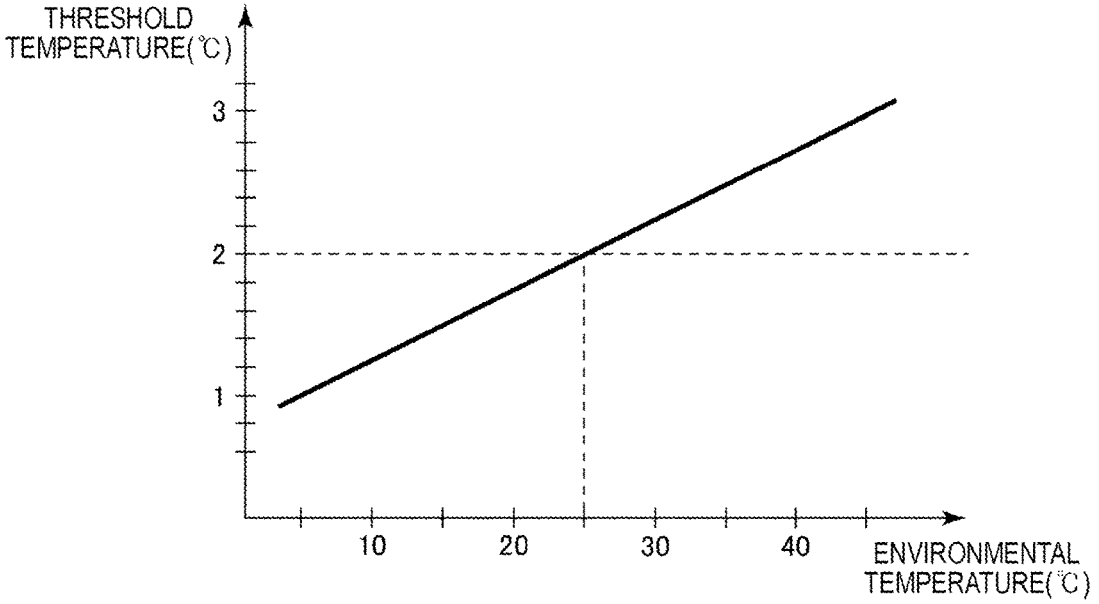
FIG. 7 is a graph illustrating a correspondence between an environmental temperature and a third threshold value.

FIG. 7 is a graph illustrating a correspondence between environmental temperature and the third threshold value TSc. In FIG. 7, the vertical axis represents the third threshold value TSc and the horizontal axis represents the environmental temperature. The third threshold value TSc is set to 2° C., for example, if the environmental temperature is 25° C. Then, if the environmental temperature becomes less than 25° C., the third threshold value TSc is reduced. When the environmental temperature becomes lower, the temperature of the heater 51 does not rise as easily. Therefore, the third threshold value TSc can be reduced. That is, the inclination of the temperature change per unit time is made gentle. Thus, even if the temperature of the heater 51 becomes more difficult to increase, it is possible to effectively prevent overheating such that the temperature of the heater 51 does not exceed the upper limit temperature. Accordingly, even if the environmental temperature is low, overheating of the heater 51 can be reliably prevented.

If the environmental temperature becomes higher than 25° C., the third threshold value TSc can be increased. When the environmental temperature becomes high, the initial (pre-energization) temperature of the heater 51 tends to rise as well. Therefore, the third threshold value TSc is increased. That is, the inclination of the temperature change per unit time is made steep. Thus, even if the starting temperature of the heater 51 increases, it is possible to effectively prevent overheating such that the temperature of the heater 51 does not exceed the upper limit temperature. Accordingly, even if the environmental temperature is high, overheating of the heater 51 can be reliably prevented.

Figure 8:
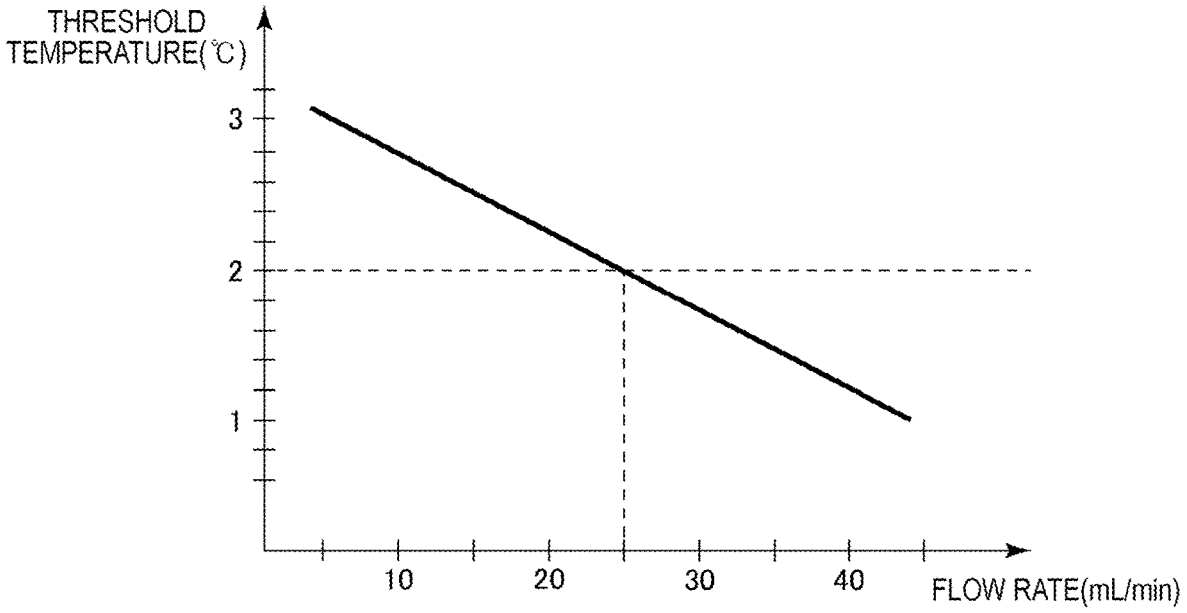
FIG. 8 is a graph illustrating a correspondence between an ink flow rate and a third threshold value.

FIG. 8 is a graph illustrating a correspondence between the ink flow rate of the circulation path 36 and the third threshold value TSc. In FIG. 8, the vertical axis represents the third threshold value TSc and the horizontal axis represents the ink flow rate. The third threshold value TSc is set to 2° C., for example, when the ink flow rate is 25 ml/min. Then, if the ink flow rate is more than 25 ml/min, the third threshold value TSc can be reduced. When the ink flow rate increases, the temperature of the heater 51 does not rise as easily. Therefore, the third threshold value TSc can be reduced. That is, the inclination of the temperature change per unit time is made gentle. Thus, even if the ink flow rate increases, it is possible to effectively prevent overheating such that the temperature of the heater 51 does not exceed the upper limit temperature. Accordingly, even if the ink flow rate increases, overheating of the heater 51 can be reliably prevented.

If the ink flow rate is less than 25 ml/min, the third threshold value TSc can be increased. For example, if the ink flowing through the circulation path 36 entrains a large amount of air bubbles, then less heat is taken away by the ink circulation, and thus the temperature of the heater 51 rises more abruptly. Therefore, the third threshold value TSc is increased. That is, the inclination of the temperature change per unit time is made steeper. Thus, even if the temperature of the heater 51 rises abruptly, it is possible to effectively prevent overheating such that the temperature of the heater 51 does not exceed the upper limit temperature. Accordingly, even if the ink flow rate decreases, overheating of the heater 51 can be reliably prevented.

In the first embodiment, the unit time for monitoring the inclination of the temperature change is set to one second. The unit time is not limited to one second. The unit time may be greater than one second, or less than one second.

Second Embodiment

Next, a second embodiment will be described with reference to FIGS. 9 to 11. Differences between the second embodiment and the first embodiment relate to the functioning of the processor 61 with respect to the overheating monitoring control processing 612. The processing other than the overheating monitoring control processing 612 is common to the first embodiment, and FIGS. to 4 are applied to the second embodiment without any change, and thus detailed descriptions thereof will be omitted.

Figure 9:
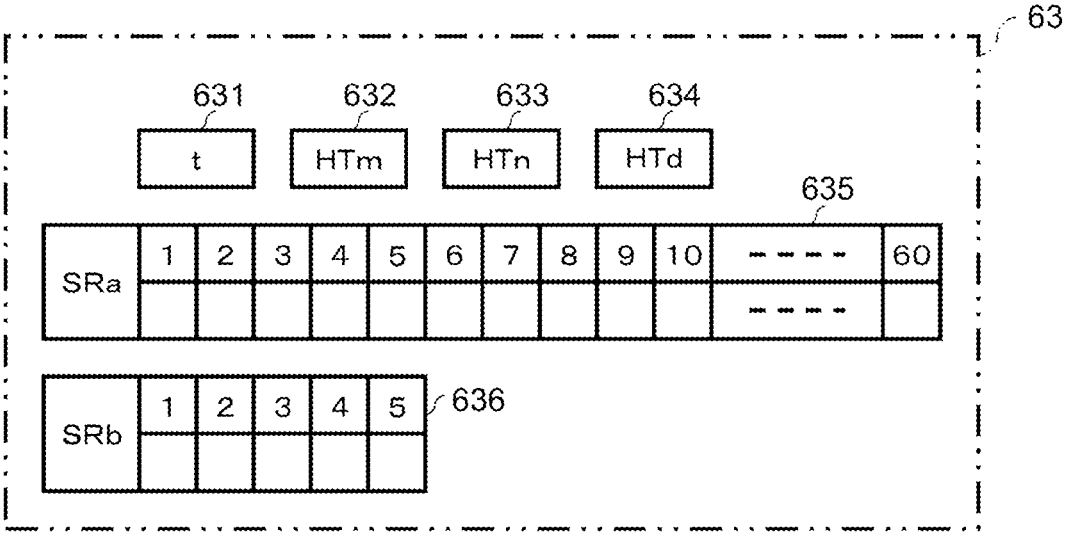
FIG. 9 depicts data stored in a RAM of an ink jet controller according to a second embodiment.

FIG. 9 depicts data stored in the RAM 63. In the second embodiment, the RAM 63 includes an area for a timer counter 631, an area for a first temperature 632, an area for a second temperature 633, an area for a temperature difference 634, an area for a first shift register 635, and an area as a second shift register 636. Those areas are provided for each liquid discharge apparatus 10.

The timer counter 631 stores time t in synchronization with the timer 64. The first temperature 632 is the temperature of the heater 51 measured by the first temperature sensor 52. In the following, the first temperature 632 stored in the RAM 63 is referred to as a heater temperature HTm. The second temperature 633 is the temperature of the heater 51 previously stored as the first temperature 632. In the following, the second temperature 633 stored in the RAM 63 is represented as a heater temperature HTn. The temperature difference 634 is a difference value between the heater temperature HTm (the first temperature 632) and the heater temperature HTn (the second temperature 633). In the following, the temperature difference 634 is represented as a difference temperature HTd.

The first shift register 635 includes sixty data storage areas SRa (1-60) referred to as the first to the sixtieth storage areas SRa. The first shift register 635 sequentially shifts data stored in each of the first to the fifty-ninth data storage areas SRa (1-59) to the second to the sixtieth data storage areas SRa (2-60) according to the timing of data shift, and stores new data in the first data storage area SRa which was made vacant by the shift. The second shift register 636 includes five data storage areas SRb (1-5) referred to as the first to the fifth storage areas SRb. The second shift register 636 sequentially shifts data stored in each of first to fourth data storage areas SRb (1-4) to second to fifth data storage areas SRa (2-5) according to the timing of the data shift, and stores new data in the first data storage area SRb which was made vacant by the shift.

Figure 10:
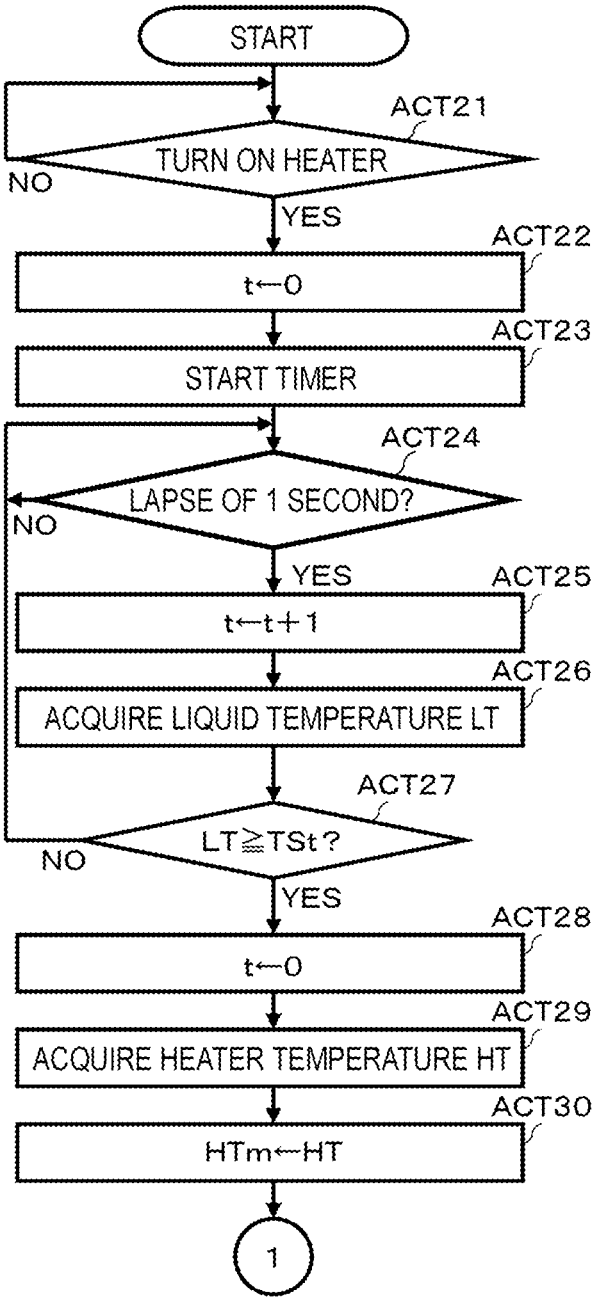
FIG. 10 is a flowchart of overheating monitoring control processing according to a second embodiment.
Figure 11:
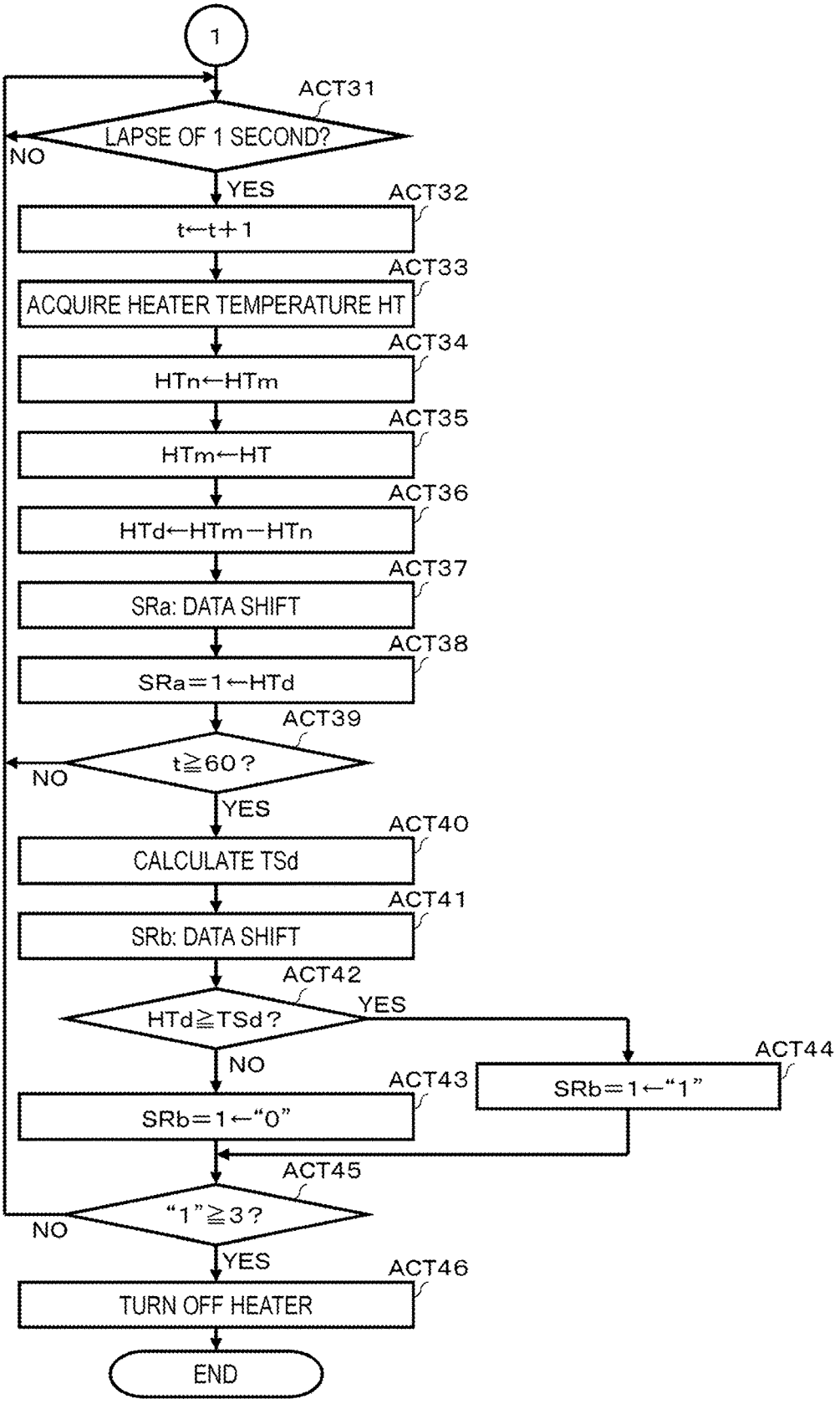
FIG. 11 is a flowchart of overheating monitoring control processing according to a second embodiment.

FIGS. 10 and 11 are flowcharts of the overheating monitoring control processing 612 performed on one liquid discharge apparatus 10 in the second embodiment. The overheating monitoring control processing 612 for the other liquid discharge apparatuses 10 is similar, and thus the description here will be omitted. The heater 51, the first temperature sensor 52, and the second temperature sensor 53, are provided in the liquid circulation device 30 of the target liquid discharge apparatus 10. The timer counter 631, the first temperature 632, the second temperature 633, the temperature difference 634, the first shift register 635, and the second shift register 636 are stored in the RAM 63 for the target liquid discharge apparatus 10.

The processor 61 waits for energization to the heater 51 to be turned ON as ACT 21. As described above, in ACT 1 of FIG. 4, energization to the heater 51 is turned ON. If the processor 61 detects that energization to the heater 51 is turned ON, the processor 61 determines that the check result in ACT 21 is YES and proceeds to ACT 22. The processor 61 resets the time t of the timer counter 631 to zero as ACT 22.

Next, the processor 61 starts the timer 64 as ACT 23. Then, the processor 61 waits for one second to elapse using the timer 64 as ACT 24. Once one second elapses, the processor 61 determines that the result in ACT 24 is YES and proceeds to ACT 25. The processor 61 increments the time t of the timer counter 631 by one as ACT 25.

The processor 61 acquires the liquid temperature LT measured by the second temperature sensor 53 as ACT 26. The liquid temperature LT is the temperature of the ink flowing through the second pipeline 362. The processor 61 checks whether the liquid temperature LT reaches a target temperature TSt as ACT 27. The target temperature TSt is any temperature equal to or greater than the second threshold value TSb, which is the lower limit temperature of the suitable temperature range for ejecting ink droplets, and equal to or lower than the first threshold value TSa, which is the upper limit temperature of the suitable temperature range for ejecting ink droplets. The target temperature TSt is set within the range between the second threshold value TSb or more and the first threshold value TSa or less described above.

Initially, when energization to the heater 51 is turned ON, the liquid temperature LT must be lower than the target temperature TSt. The processor 61 determines that the check result in ACT 27 is NO and returns to ACT 24. The processor 61 executes the processes of ACT 24 and subsequent actions in the same manner as described above. That is, the processor 61 acquires the liquid temperature LT every second and waits for the temperature to rise to the target temperature TSt.

If the liquid temperature LT reaches the target temperature TSt, the processor 61 determines that the check result in ACT 27 is YES and proceeds to ACT 28. The processor 61 resets the time t of the timer counter 631 to zero as ACT 28. The processor 61 acquires the heater temperature HT measured by the first temperature sensor 52 as ACT 29. The processor 61 rewrites the heater temperature HTm stored as the first temperature 632 with the heater temperature HT measured by the first temperature sensor 52 as ACT 30. After that, the processor 61 proceeds to ACT 31 of FIG. 11.

The processor 61 waits for one second to elapse as ACT 31. If one second elapses, the processor 61 determines that the check result in ACT 31 is YES and proceeds to ACT 32. The processor 61 increments the time t of the timer counter 631 as ACT 32.

The processor 61 acquires the heater temperature HT measured by the first temperature sensor 52 as ACT 33. The processor 61 rewrites the temperature HTn stored as the second temperature 633 with the temperature HTm stored as the first temperature 632 as ACT 34. Then, the processor rewrites the temperature HTm stored as the first temperature 632 with the heater temperature HT acquired in ACT 33, as ACT 35. The processing order of the processes of ACT 33 and ACT 34 may be changed. That is, after rewriting the temperature HTn (the second temperature 633) with the temperature HTm (the first temperature 632), the heater temperature HT measured by the first temperature sensor 52 may be acquired, and the temperature HTm (the first temperature 632) may be rewritten with the heater temperature HT.

The processor 61 calculates a difference value between the temperature HTn stored as the second temperature memory 633 and the temperature HTm stored as the first temperature memory 632, and stores the calculated difference temperature HTd in the RAM 63, as ACT 36. That is, the processor 61 stores the amount of change in the heater temperature HT in the latest one second as the difference temperature HTd in the RAM 63. Incidentally, the difference temperature HTd becomes a positive value if the heater temperature HT rises in the latest one second, and becomes a negative value if the heater temperature HT falls in the latest one second.

The processor 61 sequentially shifts data stored in each of the first to fifty-ninth data storage areas SRa of the first shift register 635 to the second to sixtieth data storage areas SRa as ACT 37. Then, the processor 61 writes the difference temperature HTd stored as the temperature difference 634 to the first data storage area SRa vacated by the data shift as ACT 38.

The processor 61 checks whether the time t of the timer counter 631 reaches a value of "60" as ACT 39. If the time t of the timer counter 631 has not yet reached "60", the processor 61 determines that the check result in ACT 39 is NO and returns to ACT 31. The processor 61 executes the processes of ACT 31 and subsequent actions in the same manner as described above. That is, the processor 61 acquires the present heater temperature HT (temperature HTm) every second, calculates the difference temperature HTd from the heater temperature HT (temperature HTn) acquired one second before, and repeats the process of writing the difference temperature HTd into the first shift register 635 while sequentially shifting the difference temperature HTd. Thus, once the time t of the timer counter 631 reaches "60", the difference temperature HTd for the past 1 minute, that is, the amount of change in the heater temperature HT every second is stored in time series in all of the first to sixtieth data storage areas SRa of the first shift register 635.

The processor 61 calculates a fourth threshold value TSd based on each difference temperature HTd of the first shift register 635 as ACT 40. Specifically, the processor 61 acquires all the positive values, that is, the difference temperature HTd if the heater temperature HT rises in one second, among the difference temperatures HTd in the past 1 minute. Then, the processor 61 calculates an average value of the acquired total difference temperatures HTd, and sets a value 1.5 times the average value as the fourth threshold value TSd.

The processor 61 sequentially shifts data stored in the first to fourth data storage areas SRb of the second shift register 636 to the second to fifth data storage areas SRb as ACT 61. The processor 61 checks whether the difference temperature HTd stored as the temperature difference memory 634 is equal to or greater than the fourth threshold value TSd as ACT 42.

If the difference temperature HTd is less than the fourth threshold value TSd, it is determined that the inclination of the temperature change per unit time of the heater 51 does not cause overheating of the heater 51. However, if the difference temperature HTd becomes equal to or greater than the fourth threshold value TSd, it is determined that there is a risk of overheating of the heater 51.

If the difference temperature HTd is less than the fourth threshold value TSd, the processor 61 determines that the check result in ACT 42 is NO and proceeds to ACT 43. The processor 61 writes data "0" into the first data storage area SRb of the second shift register 636 vacated by the data shift as ACT 43. The data "0" is data indicating that the difference temperature HTd is less than the fourth threshold value TSd.

On the other hand, if the difference temperature HTd is equal to or greater than the fourth threshold value TSd, the processor 61 determines that the check result in ACT 42 is YES and proceeds to ACT 44. The processor 61 writes data "1" into the first data storage area SRb of the second shift register 636 vacated by the data shift as ACT 44. The data "1" is data indicating that the difference temperature HTd is equal to or greater than the fourth threshold value TSd.

After finishing the process of ACT 43 or ACT 44, the processor 61 proceeds to ACT 45. The processor 61 checks whether three or more the data "1" are stored in the data storage areas SRb of the second shift register 636 as ACT 45. If two or less the data "1" are present, the processor 61 determines that the check result in ACT 45 is NO and returns to ACT 30. That is, if the number of times of occurrences of the inclination of the temperature change per unit time of the heater 51, which should be recognized as having a risk of causing overheating of the heater 51, is two or less in the past five seconds, the processor 61 continues monitoring by the overheating monitoring control processing 612. The processor 61 executes the processes of ACT 30 and subsequent actions in the same manner as described above.

On the other hand, if three or more the data "1" are present, the processor 61 determines that the check result in ACT 45 is YES and proceeds to ACT 46. The processor 61 turns OFF energization to the heater 51 as ACT 46. That is, if the number of times of occurrences of the inclination of the temperature change per unit time of the heater 51, which should be recognized as having a risk of causing overheating of the heater 51, reaches three in the past five seconds, the processor 61 stops the heater 51 and stops monitoring by the overheating monitoring control processing 612. Thus, the processor 61 ends the control of the procedure illustrated in the flowcharts of FIGS. 10 and 11.

Here, the processor 61 functions as a recording unit by executing the processes of ACT 33 to ACT 38 in FIG. 11. That is, the processor 61 uses the first shift register 635 of the RAM 63 to record data of the temperature of the heater 51 measured by the first temperature sensor 52. The data of the temperature is the difference temperature HTd, that is, the temperature change amount of the heater 51 for each unit time.

The processor 61 functions as a determination unit by executing the process of ACT 40 of FIG. 11. That is, the processor 61 determines the fourth threshold value TSd based on data recorded by the recording unit. Specifically, the processor 61 determines 1.5 times the average of the positive temperature change amounts as the fourth threshold value TSd.

Furthermore, the processor 61 functions as a control unit by executing the processes of ACT 41 to ACT 46 of FIG. 11. That is, the processor 61 monitors the temperature change of the heater 51 based on data recorded by the recording unit, and turns off the heater 51 if the temperature change satisfies the stop condition. Specifically, if the temperature change amount per unit time of the heater 51 exceeds the fourth threshold value TSd three times or more in five seconds, the processor 61 determines that the temperature change satisfies the stop condition, and stops the output of the heater 51.

Also in such a configuration, if the risk of overheating of the heater 51 increases, energization to the heater 51 is automatically turned OFF. Accordingly, it is possible to prevent the thermal fuse from operating or the heater from breaking. There is no concern that the temperature in the vicinity of the heater 51 will rise abruptly and the ink characteristics will be altered. In the second embodiment, the temperature change per unit time obtained from the measured value of the temperature of the heater 51 is recorded in the RAM 63. Then, overheating of the heater 51 is predicted from the number of times of occurrences of the inclination of the temperature change per unit time of the heater 51 which should be recognized as having a risk of overheating of the heater 51. Accordingly, overheating of the heater 51 can be prevented more reliably.

In the second embodiment, the processor 61 checks whether the liquid temperature LT reaches the target temperature TSt as ACT 27. Regarding this point, any change may be made so as to check whether the time t of the timer counter 631 reaches a set time. The set time is any given time at which the liquid temperature LT is assumed to reach the target temperature TSt. In such a case, the processor 61 determines that the check result in ACT 27 is NO until the time t of the timer counter 631 reaches the set time. If the time t reaches the set time, the processor 61 determines that the check result in ACT 27 is YES.

In the second embodiment, the processor 61 calculates the difference temperature HTd from the heater temperature HT one second before and records the difference temperature HTd in the first shift register 635. Regarding this point, for example, the difference temperature from the heater temperature HT two seconds before may be calculated and the difference temperature may be recorded in the first shift register 635.

The processor 61 records, for example, the heater temperature HT measured every second in the first shift register 635. Then, the processor 61 obtains the difference temperature HTd from the heater temperature HT recorded in the adjacent data storage area SRa and calculates the fourth threshold value TSd. The processor 61 checks whether the difference temperature HTd between the heater temperature HT of the first data storage area SRa and the heater temperature HT of the second data storage area SRa is equal to or greater than the fourth threshold value TSd. That is, the temperature data recorded by the recording unit may be used as the temperature HT of the heater 51.

In the second embodiment, the fourth threshold value TSd is calculated as 1.5 times the average of the positive temperature change amounts. The method for calculating the fourth threshold value TSd is not limited to the method for calculating the fourth threshold value TSd as described above. For example, the fourth threshold value TSd may be calculated by setting a value greater than 1.5 or a value smaller than 1.5, instead of 1.5 times, as a multiple of the average of positive temperature change amounts. Alternatively, the fourth threshold value TSd may be a fixed value which is randomly set.

In the second embodiment, the processor 61 continues monitoring by the overheating monitoring control processing 612 if the number of times of occurrences of the inclination of the temperature change per unit time of the heater 51, which should be recognized as having a risk of overheating of the heater 51, is two or less in the past five seconds, and stops the heater 51 and monitoring if the number of times of occurrences is three or more. The timing of stopping monitoring is not limited to the timing if the number of times of occurrences of the inclination of the temperature change per unit time of the heater 51 is three or more. For example, the processor 61 may continue monitoring if the number of times of occurrences is three or less, and may stop monitoring if the number of times of occurrences is four or more. Alternatively, the processor 61 may stop monitoring if the number of times of occurrences is two or more.

In the first or second embodiment, the heater 51 is disposed in the first pipeline 361 connecting the upstream tank 31 and the liquid discharge head 20. An arrangement place of the heater 51 is not limited to the first pipeline 361. For example, the heater 51 may be disposed in the upstream tank 31.

In the first or second embodiment, the second temperature sensor 53 is disposed in the second pipeline 362 connecting the liquid discharge head 20 and the downstream tank 32. However, the arrangement location of the second temperature sensor 53 is not limited to the second pipeline 362. For example, the second temperature sensor 53 may be disposed in the middle part of the first pipeline 361 or the third pipeline 363, or may be disposed inside the upstream tank 31 or downstream tank 32. Alternatively, the second temperature sensor 53 may be disposed on the ink flow path of the liquid discharge head 20.

In the first or second embodiment, the liquid circulation device 30 and the liquid discharge apparatus 10 use ink. However, the liquid used in the liquid circulation device 30 and the liquid discharge apparatus 10 is not limited to ink. The technical concepts of the present disclosure can be applied to a liquid circulation device and a liquid discharge apparatus that use a liquid other than ink by setting the third threshold value TSc to an appropriate value.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid circulation device, comprising:
- a liquid chamber configured to store a liquid to be supplied to a liquid discharge head;
- a pipeline through which the liquid is circulated between the liquid chamber and the liquid discharge head;
- a heater configured to heat the liquid in the pipeline;
- a first temperature sensor to measure a temperature of the heater;
- a second temperature sensor to measure a temperature of the liquid in the pipeline; and
- a controller configured to:
  - control the heater based on the temperature of the liquid as measured by the second temperature sensor, and
  - monitor a change in the temperature of the heater over time as measured by the first temperature sensor and determine a rate of the change in the temperature of the heater per unit time and turn off the heater when the change satisfies a predetermined stop condition, wherein the change satisfies the predetermined stop condition when the rate of change exceeds a first threshold value.

2. The liquid circulation device according to claim 1, wherein the controller sets the first threshold value based on an environmental temperature.

3. The liquid circulation device according to claim 1, wherein the controller sets the first threshold value based on a flow rate of the liquid in the pipeline.

4. The liquid circulation device according to claim 1, further comprising:
- a memory, wherein
- the controller is further configured to:
  - store, in the memory, history data for the temperature of the heater as measured by the first temperature sensor, and
  - monitor the change in the temperature of the heater by referring to the history data in the memory.

5. The liquid circulation device according to claim 4, wherein the controller is further configured to:
- calculate the change in the temperature of the heater over time using the history data, and
- the change satisfies the predetermined stop condition when the change in the temperature of the heater exceeds a second threshold value a predetermined number of times within a particular time period.

6. The liquid circulation device according to claim 5, wherein the controller is further configured to:
- set the second threshold value based on the history data.

7. The liquid circulation device according to claim 1, wherein the pipeline includes a first portion on which the heater and the first temperature sensor are disposed and a second portion on which the second temperature sensor is disposed.

8. The liquid circulation device according to claim 7, wherein the liquid is supplied from the liquid chamber to the liquid discharge head through the first portion.

9. The liquid circulation device according to claim 1, wherein the liquid is ink.

10. A liquid discharge apparatus, comprising:
- a liquid discharge head configured to discharge a liquid;
- a liquid chamber configured to store the liquid to be supplied to the liquid discharge head;
- a pipeline through which the liquid is circulated between the liquid chamber and the liquid discharge head;
- a heater configured to heat the liquid in the pipeline;
- a first temperature sensor configured to measure a temperature of the heater;
- a second temperature sensor configured to measure a temperature of the liquid in the pipeline; and
- a controller configured to:
  - control the heater based on the temperature of the liquid measured by the second temperature sensor, and
  - monitor a change in the temperature of the heater over time as measured by the first temperature sensor and determine a rate of the change in the temperature of the heater per unit time and turn off the heater when the change satisfies a predetermined stop condition, wherein the change satisfies the predetermined stop condition when the rate of change exceeds a first threshold value.

11. The liquid discharge apparatus according to claim 10, wherein the controller sets the first threshold value based on an environmental temperature.

12. The liquid discharge apparatus according to claim 10, wherein the controller sets the first threshold value based on a flow rate of the liquid in the pipeline.

13. The liquid discharge apparatus according to claim 10, further comprising:
- a memory, wherein
- the controller is further configured to:

store, in the memory, history data for the temperature of the heater as measured by the first temperature sensor, and monitor the change in the temperature of the heater by referring to the history data in the memory.

14. The liquid discharge apparatus according to claim 13, wherein the controller is further configured to:

calculate the change in the temperature of the heater over time using the history data, and the change satisfies the predetermined stop condition when the change in the temperature of the heater exceeds a second threshold value a predetermined number of times within a particular time period.

15. The liquid discharge apparatus according to claim 14, wherein the controller is further configured to:

set the second threshold value based on the history data.

16. The liquid discharge apparatus according to claim 10, wherein the pipeline includes a first portion on which the heater and the first temperature sensor are disposed and a second portion on which the second temperature sensor is disposed.

17. The liquid discharge apparatus according to claim 16, the liquid is supplied from the liquid chamber to the liquid discharge head through the first portion.

18. A method for controlling a liquid circulation device, the method comprising:

circulating a liquid from a liquid chamber to a liquid discharge head via a pipeline;

heating the liquid in the pipeline using a heater;

measuring a temperature of the heater using a first temperature sensor;

measuring a temperature of the liquid in the pipeline using a second temperature sensor;

controlling the heater based on the temperature of the liquid measured by the second temperature sensor; and monitoring a change in the temperature of the heater as measured by the first temperature sensor and determining a rate of change in the temperature of the heater measured by the first temperature sensor per unit time and turning off the heater when the change satisfies a predetermined stop condition, wherein the change satisfies the predetermined stop condition when the rate of change exceeds a first threshold value.

* * * * *